US009450338B2

(12) United States Patent
Reeves et al.

(10) Patent No.: US 9,450,338 B2
(45) Date of Patent: Sep. 20, 2016

(54) HIGH SPEED CONNECTOR WITH RUGGEDIZED EXTERIOR STRUCTURE AND SHIELDING

(71) Applicant: Molex, LLC, Lisle, IL (US)

(72) Inventors: Jeffrey A. Reeves, North Little Rock, AR (US); Rick Vandermolen, Niagara Falls, NY (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/453,211

(22) Filed: Aug. 6, 2014

(65) Prior Publication Data

US 2016/0043509 A1 Feb. 11, 2016

(51) Int. Cl.

| | |
|---|---|
| ***H01R 13/52*** | (2006.01) |
| ***H01R 13/6581*** | (2011.01) |
| ***H01R 13/631*** | (2006.01) |
| ***H01R 13/6582*** | (2011.01) |
| ***H01R 13/6595*** | (2011.01) |
| *H01R 12/72* | (2011.01) |
| *H01R 13/622* | (2006.01) |
| *H01R 13/64* | (2006.01) |
| *H01R 13/6583* | (2011.01) |
| *H01R 13/66* | (2006.01) |
| *H01R 13/74* | (2006.01) |
| *H01R 24/60* | (2011.01) |

(52) U.S. Cl.

CPC ..... *H01R 13/6581* (2013.01); *H01R 13/631* (2013.01); *H01R 13/6582* (2013.01); *H01R 13/6595* (2013.01); *H01R 12/724* (2013.01); *H01R 13/622* (2013.01); *H01R 13/64* (2013.01); *H01R 13/6583* (2013.01); *H01R 13/6658* (2013.01); *H01R 13/746* (2013.01); *H01R 24/60* (2013.01); *H01R 2201/26* (2013.01)

(58) Field of Classification Search

CPC ..... H01R 13/622; H01R 13/623
USPC ..... 439/259, 277, 320, 625
See application file for complete search history.

(56) References Cited

U.S. PATENT DOCUMENTS

| | | | | |
|---|---|---|---|---|
| 4,808,127 A * | 2/1989 | Swanic | ..... | H01R 13/631 439/139 |
| 5,906,513 A * | 5/1999 | Peterson | ..... | H01R 9/032 439/320 |
| 6,991,494 B1 | 1/2006 | Spink, Jr. | | |

* cited by examiner

*Primary Examiner* — Vanessa Girardi
(74) *Attorney, Agent, or Firm* — James A. O'Malley; Stephen L. Sheldon

(57) ABSTRACT

A high speed connector assembly includes two interengaging connector halves each held in respective first and second interengaging connector housings. Each of the connector halves includes a plurality of conductive contacts arranged in at least two linear arrangements and at least partially surrounded by a conductive grounding shield. The connector housings are cylindrical and engage each other in a circular fashion, while the connectors engage each other in a linear, axial fashion. The connector housings provide a sealed environment for the connectors.

12 Claims, 18 Drawing Sheets

HIGH SPEED CONNECTOR WITH RUGGEDIZED EXTERIOR STRUCTURE AND SHIELDING

BACKGROUND OF THE PRESENT DISCLOSURE

The Present Disclosure relates, generally, to high speed connectors, and, more particularly, to high speed connectors enclosed within sealed housings.

High speed connectors, such as SAS and HDMI connectors, are commonly employed in devices that utilize circuit boards for mounting the connectors and these devices are static devices in their operation; i.e., they are used in interior, stable environments with no exterior forces applied to them. It is desirable to incorporate these type connectors in dynamic environments, such as vehicles and aircraft, and as such, one must ensure that the connectors, when mated, are sealed from the environment and are protected from vibrations and other exterior forces that may cause the connectors to unmate and come apart. One connector specification, particularly for use in military applications, is the D38999 specification which requires connectors to be protected from environmental factors and of the quick connect/disconnect type.

Typical D38999 connectors utilize a plurality of conductive pins arranged in a pin field in one of the connector housing halves and pin receptacles in the other connector housing half. The pins may bend, and pin fields must be painstakingly designed to derive selected electrical characteristics for the connector, which adds to the overall connector cost. Additionally, the small size available for the pin field may lead to problems in designing a pin arrangement for proper high-speed operation. High speed connectors that conform to the SAS and HDMI specifications have desirable electrical characteristics due to their shielding structure, but have not been provided with an exterior structure that satisfies the requirements for military specification. Additionally, these flat style connectors need an enclosing ground structure available to their contacts for desirable coupling. A need therefore exists for a high-speed connector that suitably meets the standards of military specifications and in which the connector halves each utilize an internal shield for reliable grounding.

The Present Disclosure is therefore directed to a connector assembly particularly suitable for such applications and vibration resistant while further having quick connect/disconnect capabilities.

SUMMARY OF THE PRESENT DISCLOSURE

Accordingly, there is provided a shielded connector assembly that is suitable for dynamic environments and which holds the high speed connector portions in place for mating.

In accordance with one embodiment that utilizes HDMI style connectors, the connector assembly includes two interengaging male and female connector components. Each connector component includes a connector half with a plurality of conductive contacts, these contacts are arranged linearly in at least two rows. The connector halves respectively include opposing, interengaging male mating blade and female receptacle portions. Mating between the two connector halves of the connector components is effected by an axial, linear movement, as in pushing the male mating blade into the female receptacle. In order to provide shielding to enhance the high speed performance thereof, each connector half has a grounding shield associated therewith held within the associated connector component. The connector contacts and their surrounding grounding shields are mated together during the linear connection movement.

The connector halves and their grounding shields are supported within inner, insulative connector housings held within the connector components. These connector housing halves are applied to the connector halves from opposite ends and preferably are held together as an assembly within their associated connector components by one or more retaining rings, the construction of which permits the inner connector halves and their insulative housings to rotate within their connector components as integral units. The outer connector components may be conductive and include easy to mate threaded collars that allow linear engagement between the two connector halves whilst rotating the outer component.

The connector shells are preferably provided with exterior threads as one means of engagement, and one shell is larger than the other shell so that the two shells may be easily engaged in a telescoping fashion with one shell extending over the other shell. In this manner, the shells may be provided with O-rings or other type of environmental seals. In order to provide enhanced grounding for the high speed connector halves, at least one of the grounding shields associated with one of the two connector shells has a length that extends entirely through the connector housing insert. This length is further equal or greater than the longest length of the exterior threads on the two connector shells. This provides an internal grounding shield that traverses about one-half of the connector length.

In another embodiment of a connector assembly in accordance with the principles of the Present Disclosure, which is particularly suitable for use with a SAS style connector pair, two connector halves are provided, one such connector half is a male plug connector that supports at least two mating blades and the other connector half is a female, receptacle connector that has two card receiving slots defined therein. Both connector halves have conductive outer shields, the plug connector half outer shield takes the form of a conductive housing that encloses a pair of circuit cards as its mating blades while the receptacle connector half takes the form of a hollow shielding cage that is attached to a circuit board. Both shields are encompassed by insulative housings that serve to position the connector halves and associated shields within their respective outer connector shells. The insulative housings are also preferably held in place within the connector shells by retaining rings so that the shells may be rotated for mating and un mating. The plug connector half projects at least slightly forwardly of the forward edge of the connector shell to define a lead-in projection for initial gross mating with the receptacle connector. The two shields engage each other and provide a shielded mating structure having a length greater than any one of the two shells.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
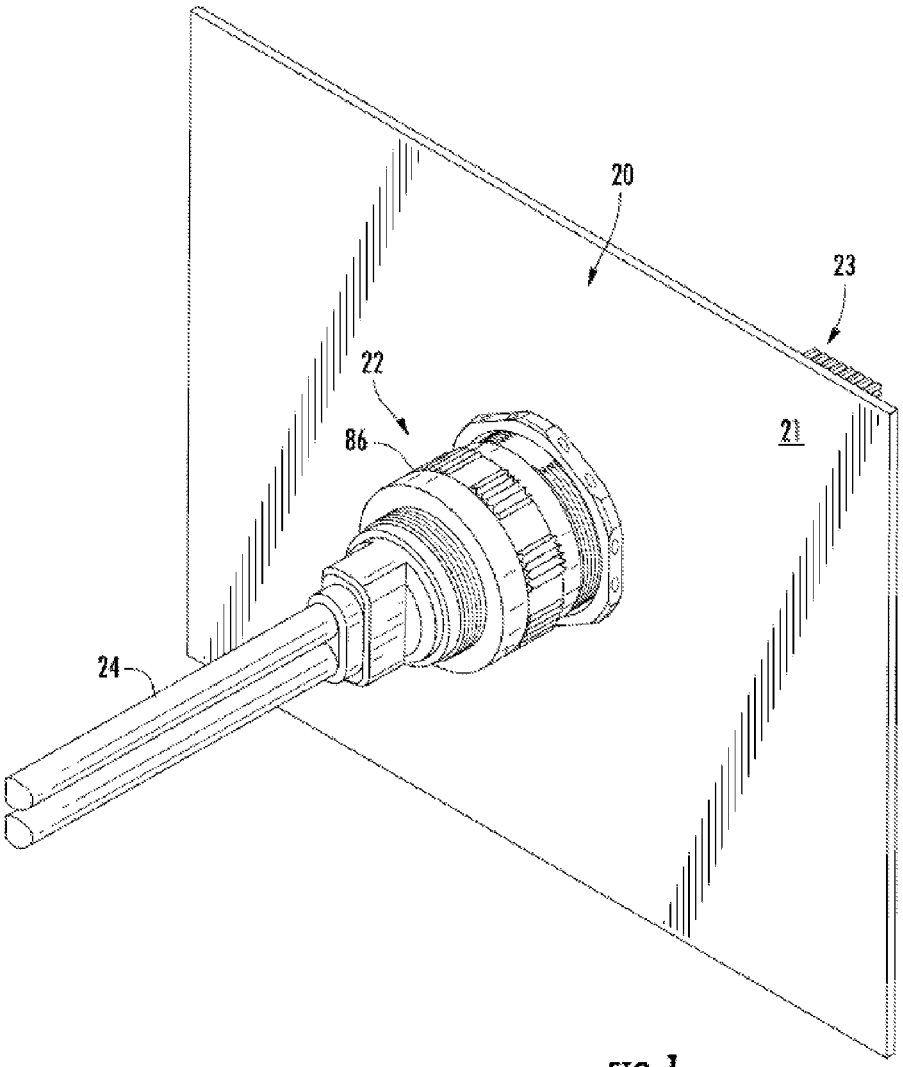
FIG. 1 is a perspective view of a connector assembly constructed in accordance with the principles of the Present Disclosure, and utilizing SAS style connector halves, with the two connector components of the connector assembly mated together on opposite sides of a panel.
Figure 1A:
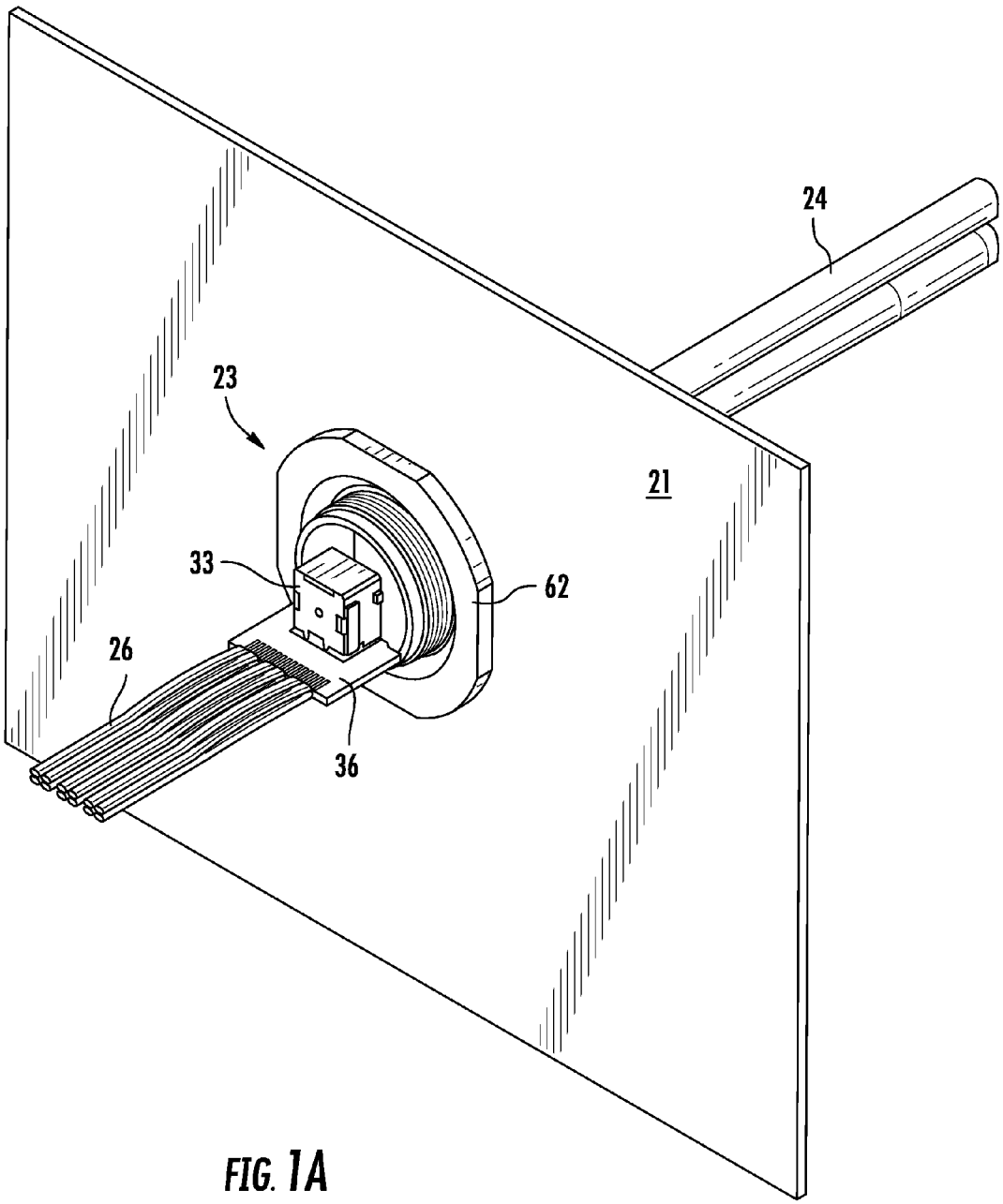
FIG. 1A is a perspective view of the connector assembly of FIG. 1, but with the assembly reversed to show the connector component mounted on the other side of the panel.
Figure 2:
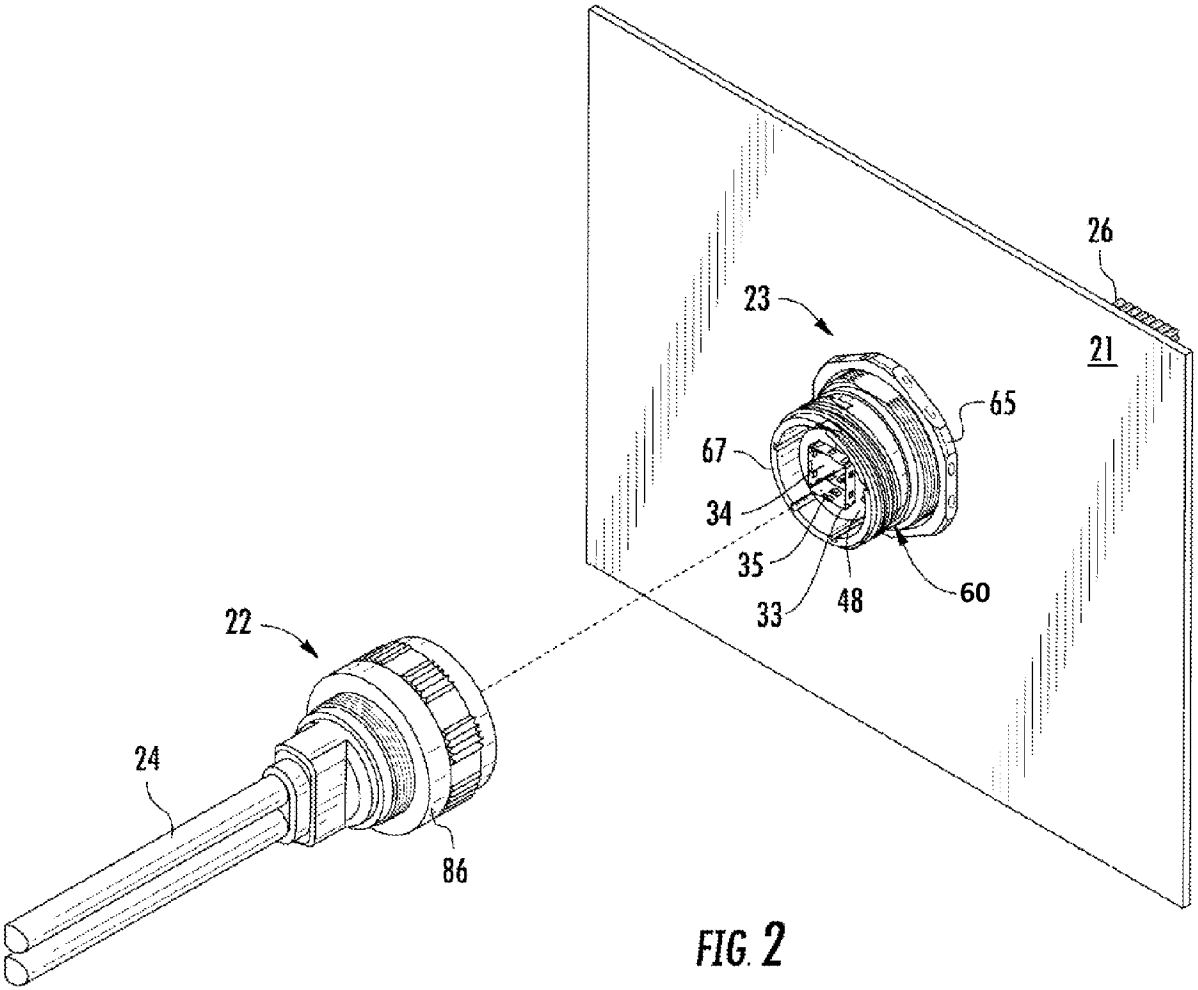
FIG. 2 is the same view as FIG. 1, but with the male connector component disengaged from the connector component secured to the panel.
Figure 2A:
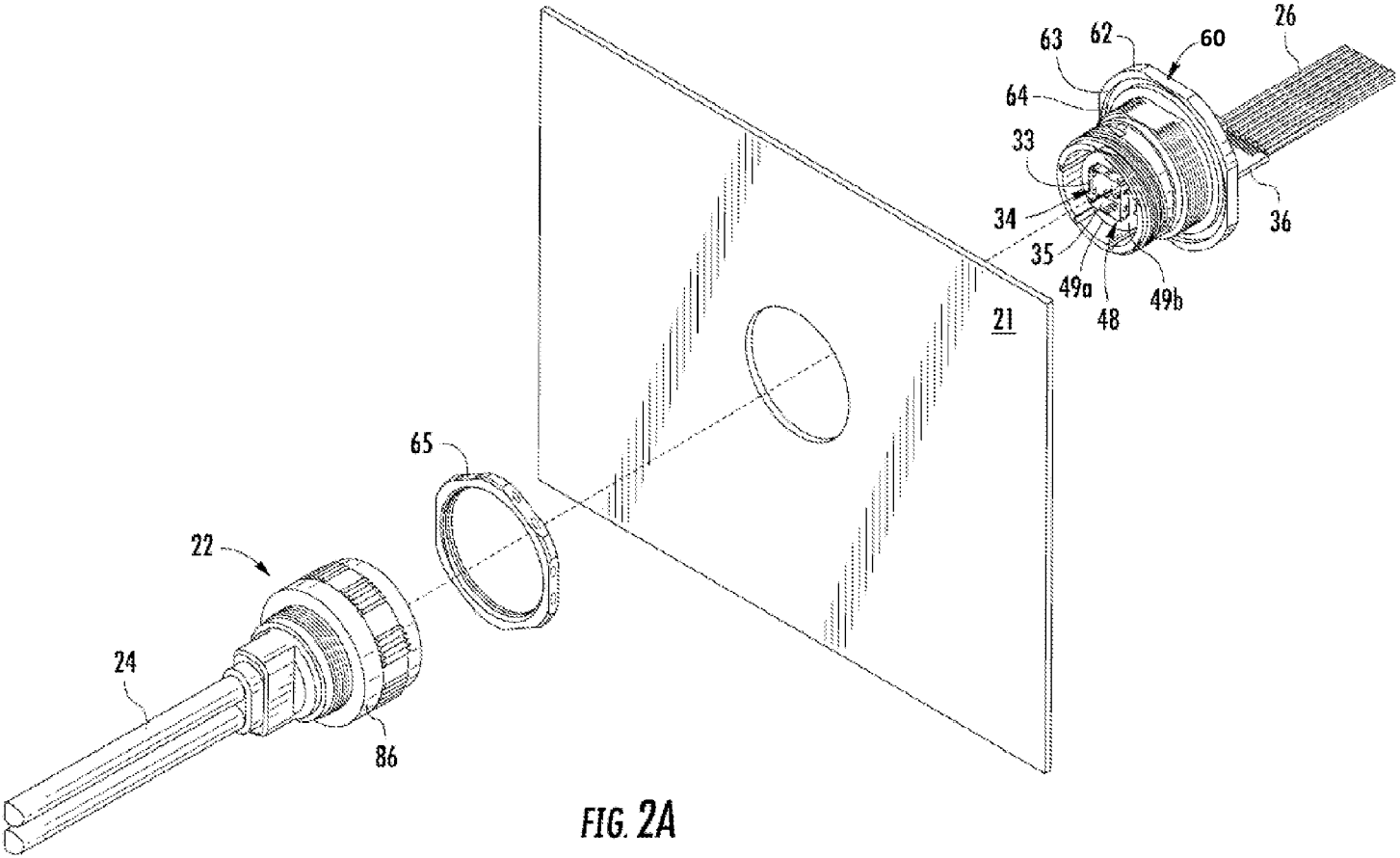
FIG. 2A is the same view as FIG. 2, but with the female connector component unscrewed from engagement with the panel.

FIG. 1 illustrates a connector assembly 20 constructed in accordance with the principles of the Present Disclosure as mounted to a panel 21. The connector assembly 20 comprises matable first and second connector elements 22, 23 that may be attached respectively to first and second electrical cables 24, 25, and which are used in applications through a panel 21. Each such cable 24, 25 contains a plurality of electrical wires (not shown). FIG. 1A shows the rear end of the rightmost, or second, connector element 23 of the connector assembly 20, and illustrates a structure where the second connector half 32 is mounted to a circuit board 36, and the circuit board 36 has a plurality of wires 26 terminated thereto and extending therefrom, but which are not enclosed within any outer cable.

The second connector element 23 is the receptacle half of the connector assembly 20, and includes a receptacle connector half 32 with a body having two horizontal circuit card-receiving slots 38 defined therein configured to receive a pair of corresponding circuit cards 71*a*, 71*b* that serve as mating blades of the opposing and mating male connector half 70. The receptacle connector half 32 is mounted to a circuit board 36, and tail portions 39*a* of the receptacle connector contacts 39 extend through holes, or vias, in the circuit board 36 to make contact with circuits thereon. Wires 26 are provided and are terminated to these circuits in order to connect the contacts 39 of the receptacle connector half 32 to other electronic components utilized in the overall system. In order to provide shielding to the receptacle connector half 32 and its associated male, or plug, connector half 70, an elongated, conductive shielding cage 33 is utilized to enclose the receptacle connector half 32. The shielding cage 33 has top, bottom, rear and side walls that are stamped and formed to form a rectangular enclosure with a hollow interior 34 and an opening 35 thereto disposed at the front end of the shielding cage 33. As shown in FIG. 4A, an attachment screw 46 is provided and extends through an opening in the circuit board 36 and into a retention nut 47 preferably captured within the insulative body portion of the receptacle connector half 32. This screw 46 assists in holding both the receptacle connector half 32 and the shielding cage 33 in place on the circuit board 36.

The shielding cage 33 provides a reference ground for the mated contacts of the connector assembly 20, and also prevents the emission of EMI (electromagnetic interference) during high speed data transmission. In order to position the receptacle connector half 32 properly within a second connector shell 30, an inner insulative housing 48 is provided. The inner housing 48 has two halves 49*a*, 49*b* mated together along a center line as shown, although other forms of engagement may be used. The inner housing 48 includes a plurality of channels, or slots 44,45, that accommodate the attachment screw 46, mounting tails of the shielding cage 33 and/or the receptacle connector half 32 that may project beyond the bottom surface of the circuit board 36. Side slots 44*a* can also be utilized that engage the sides of the circuit board 36 and, preferably, the inner housing 48 has a forward stop surface 50, or shoulder portion, that abuts the front end 51 of the circuit board 36 to fix the position of the circuit board 36 and attached receptacle connector half 32 within the second connector shell 30. Crush ribs (not shown) may be provided arranged on the interior of the inner housing slots to firmly engage the shielding cage 33.

The inner housing 48 is shown as having a stepped profile that defines a front part 53 and a rear part 54, with an intervening rim 56 that abuts the inner surface of an opposing shoulder 58 of the second connector shell 60. One or more retaining rings 59 are shown as engaging the forward part 53 of the inner housing 48 and fixing the inner housing forward part 53 within the second connector shell 60. The outer part of the second connector shell 60 has a threaded body portion that terminates in a radial flange 62, which may be placed into abutting contact with the panel 21 to which the connector assembly 20 is mounted. The flange 62 may support a flexible O-ring 64 or the like in a groove, or channel 63, against the panel 21. The second connector shell 60 is held in place upon the panel 20 by a threaded lock nut 65.

FIGS. 3A-5 illustrate the first connector element 22 that houses the male connector half 70 of the connector assembly 20. This male connector half 70 (FIG. 3A) includes a pair of vertically spaced-apart circuit cards 71*a*, 71*b* supported within a conductive connector housing 72 which has a generally rectangular forward part 76 and a larger, generally trapezoidal configuration rear part 77 that accommodates multi-wire cables 24. The conductive connector housing 72 thereby serves as a grounding shield that encompasses the first connector half 70. The forward part 76 of the male connector half 70 is hollow and preferably dimensioned to fit within the hollow interior 34 of the shielding cage 33 that houses the receptacle connector half 32. An EMI gasket 74 in the form of a rectangular collar with a plurality of spaced-apart spring fingers 75 is disposed on the connector housing 72 in a location where the gasket fingers 75 will make contact with the interior walls of the shielding cage 33 when the first and second connector elements 22, 23 are mated together. A boot portion 80 of an inner housing 78 is provided to engage the rear part 77 of the connector housing 72, and it may be molded onto and over the connector housing 72 or formed as a separate element pressed over the rear part 77 of the connector housing 72. For this connector half, as well as the other two connector halves to follow, the inner housing is formed from two parts that are applied from opposite ends of the connector halves.

Figure 3:
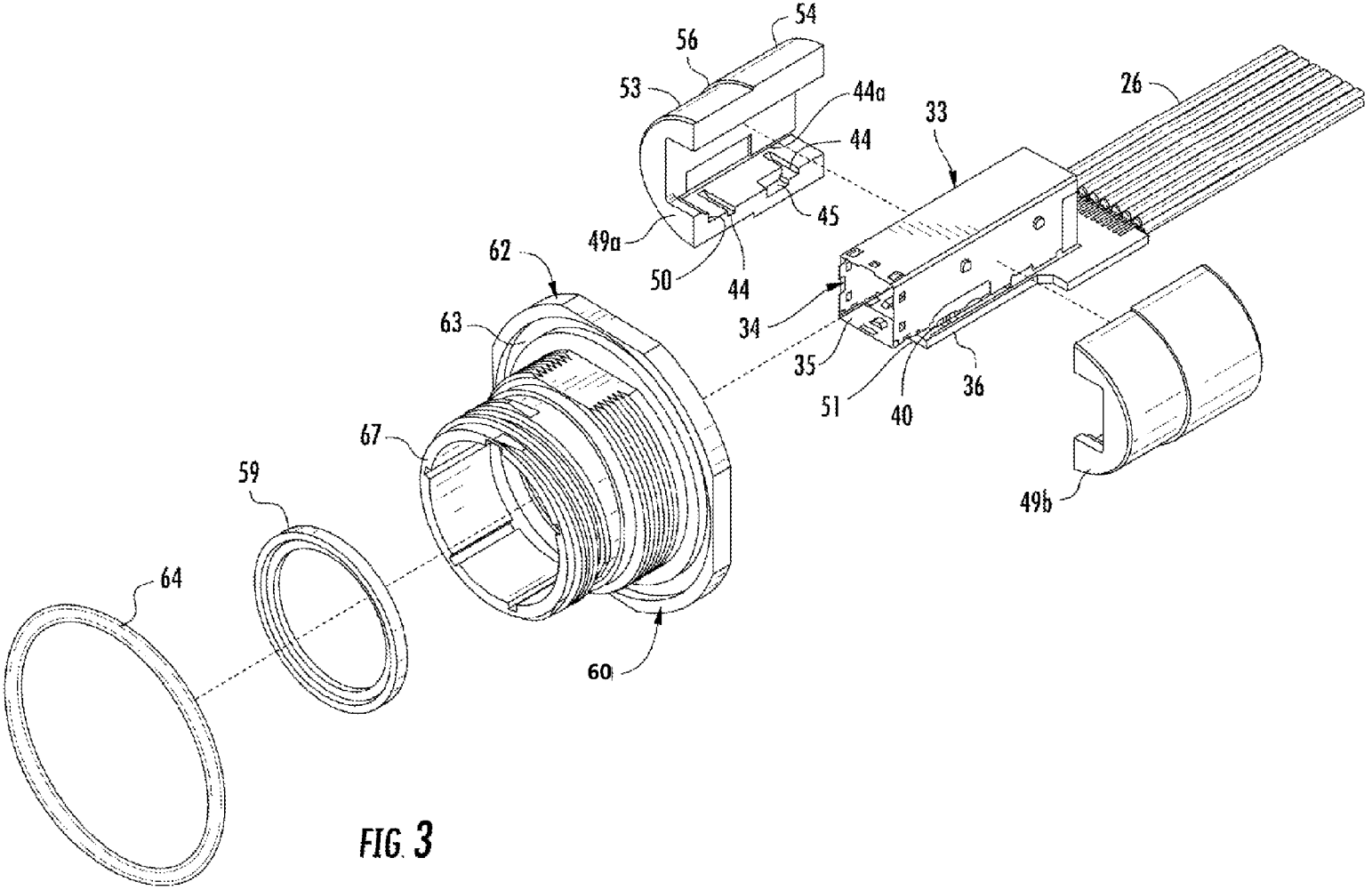
FIG. 3 is an exploded view of the right half, or female connector component, of the connector assembly of FIG. 1.
Figure 3A:
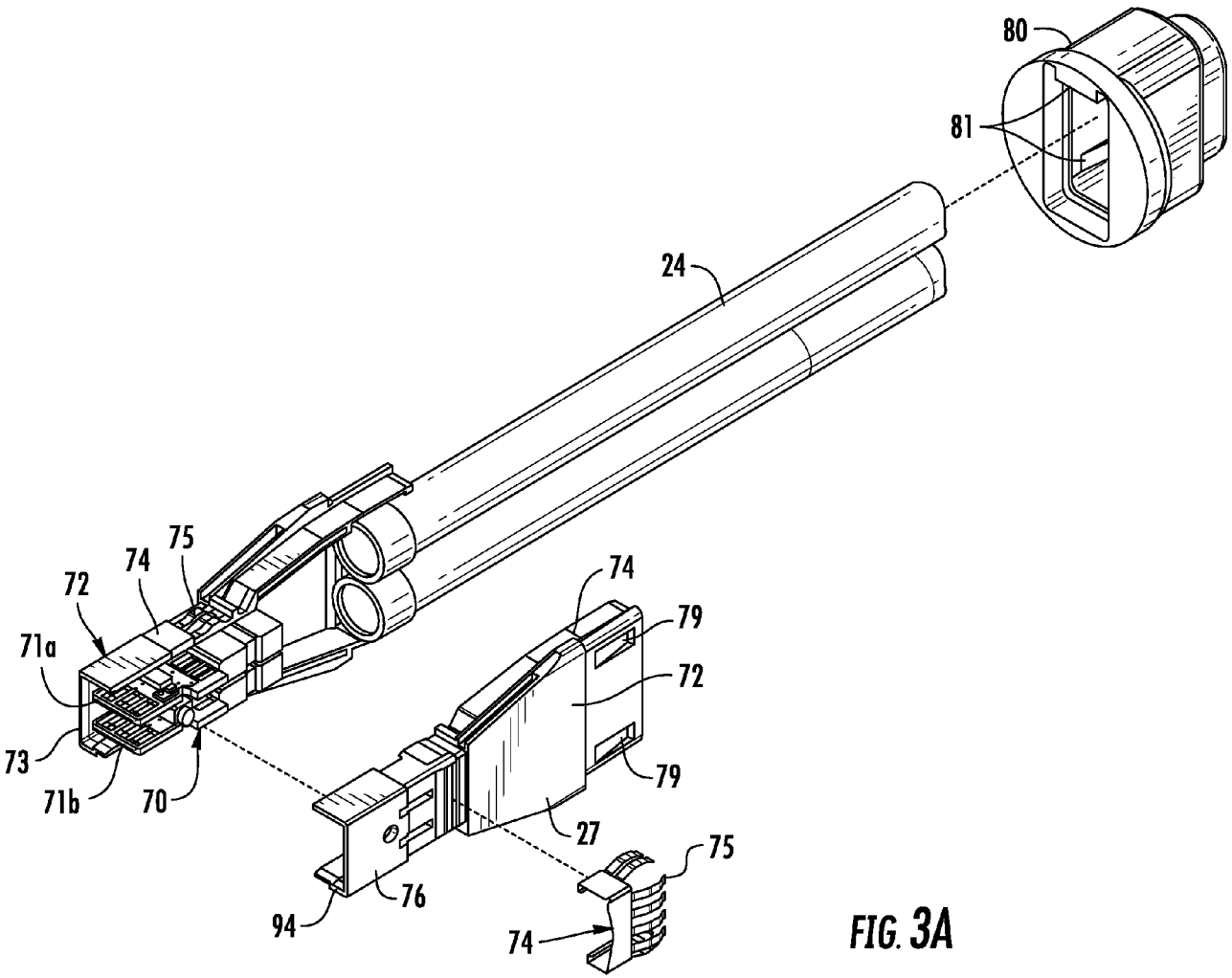
FIG. 3A is an exploded view of the left half, or male connector component, of the connector assembly of FIG. 1, with the inner housing and connector shell removed for clarity.
Figure 3B:
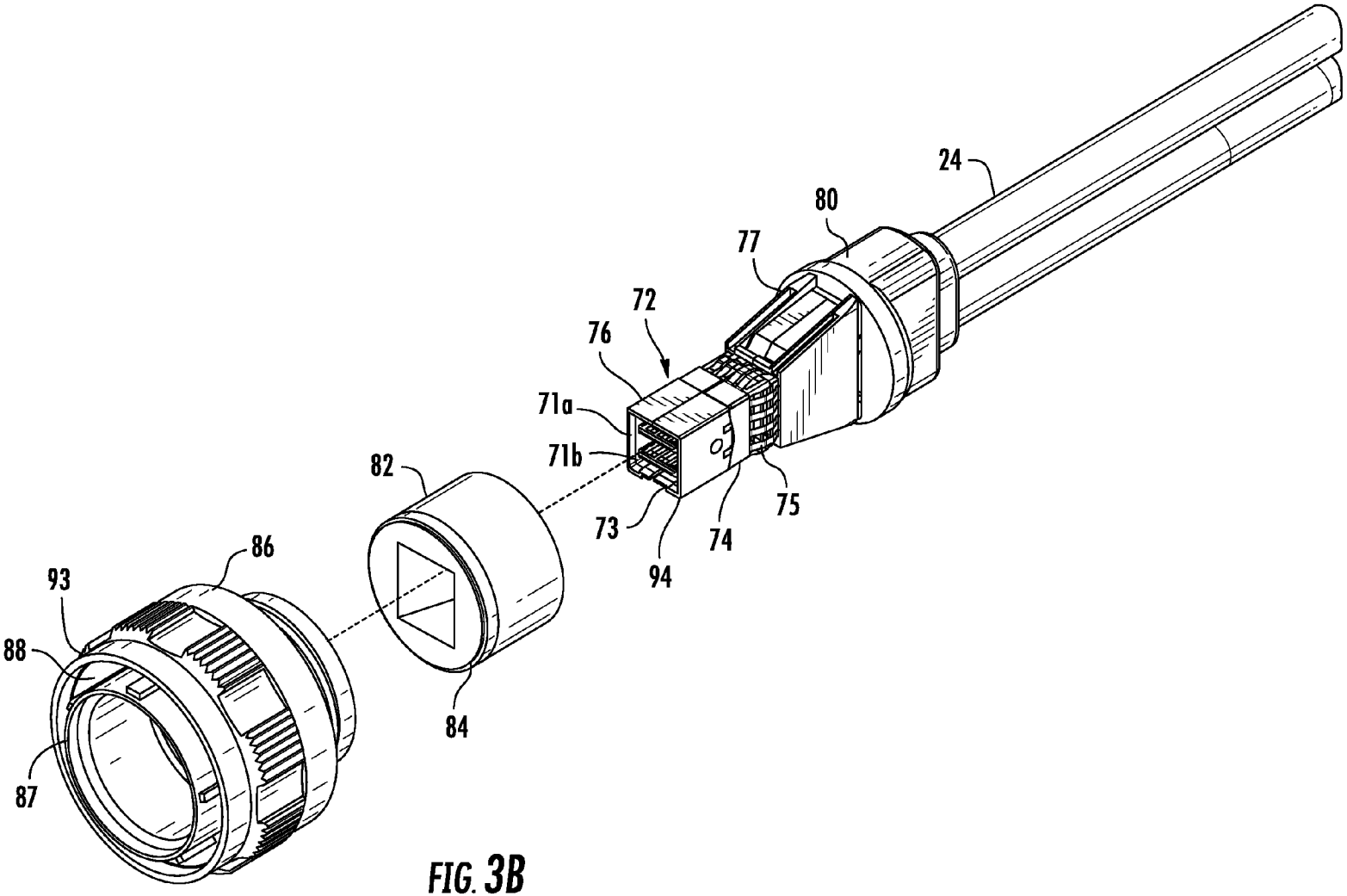
FIG. 3B is the same view as FIG. 3A, but with the rear boot applied to the connector half and the inner housing and shell exploded for clarity.
Figure 4:
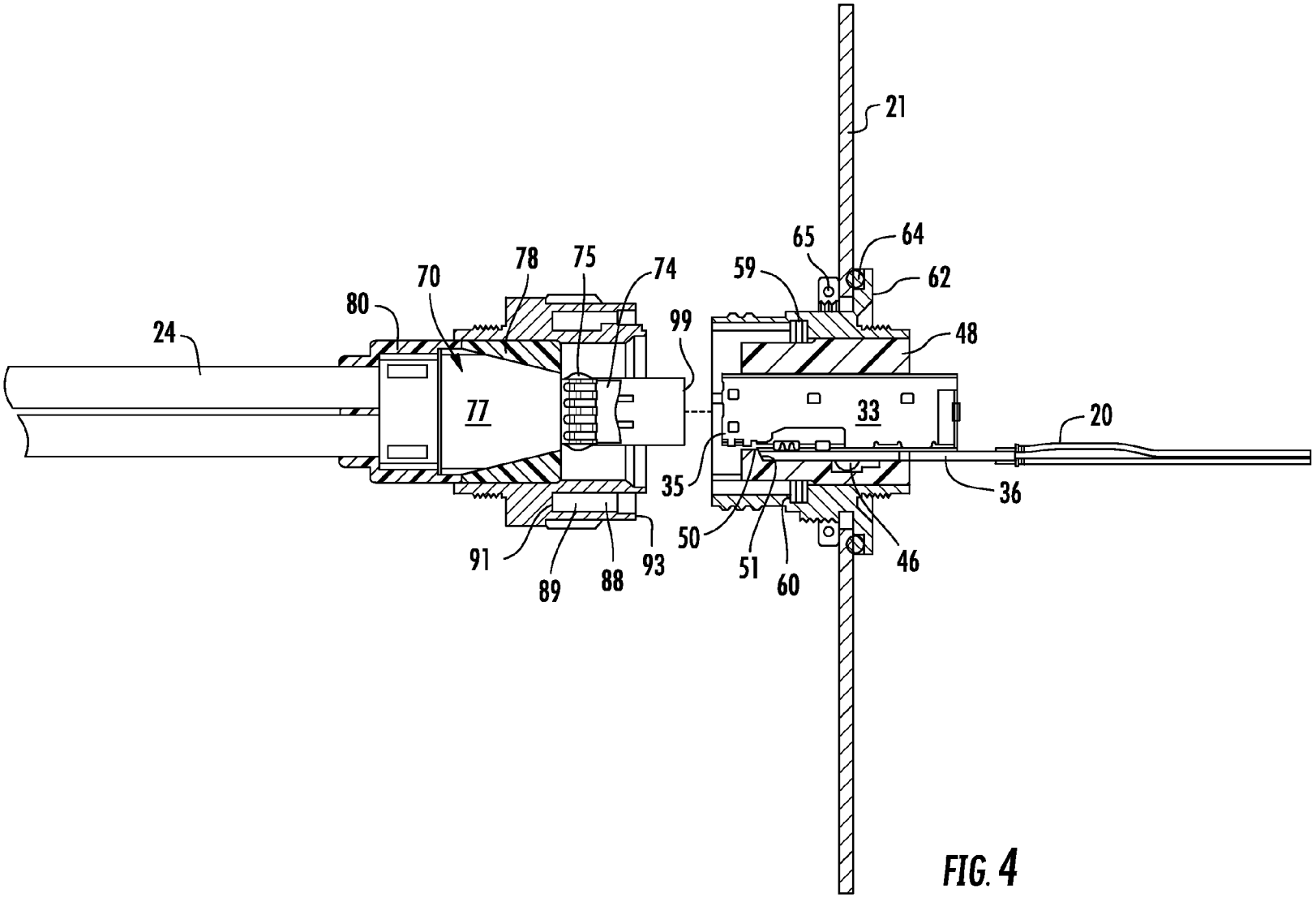
FIG. 4 is a partial sectional view of the two connector components of the connector assembly of FIG. 1, aligned together for subsequent mating.
Figure 4A:
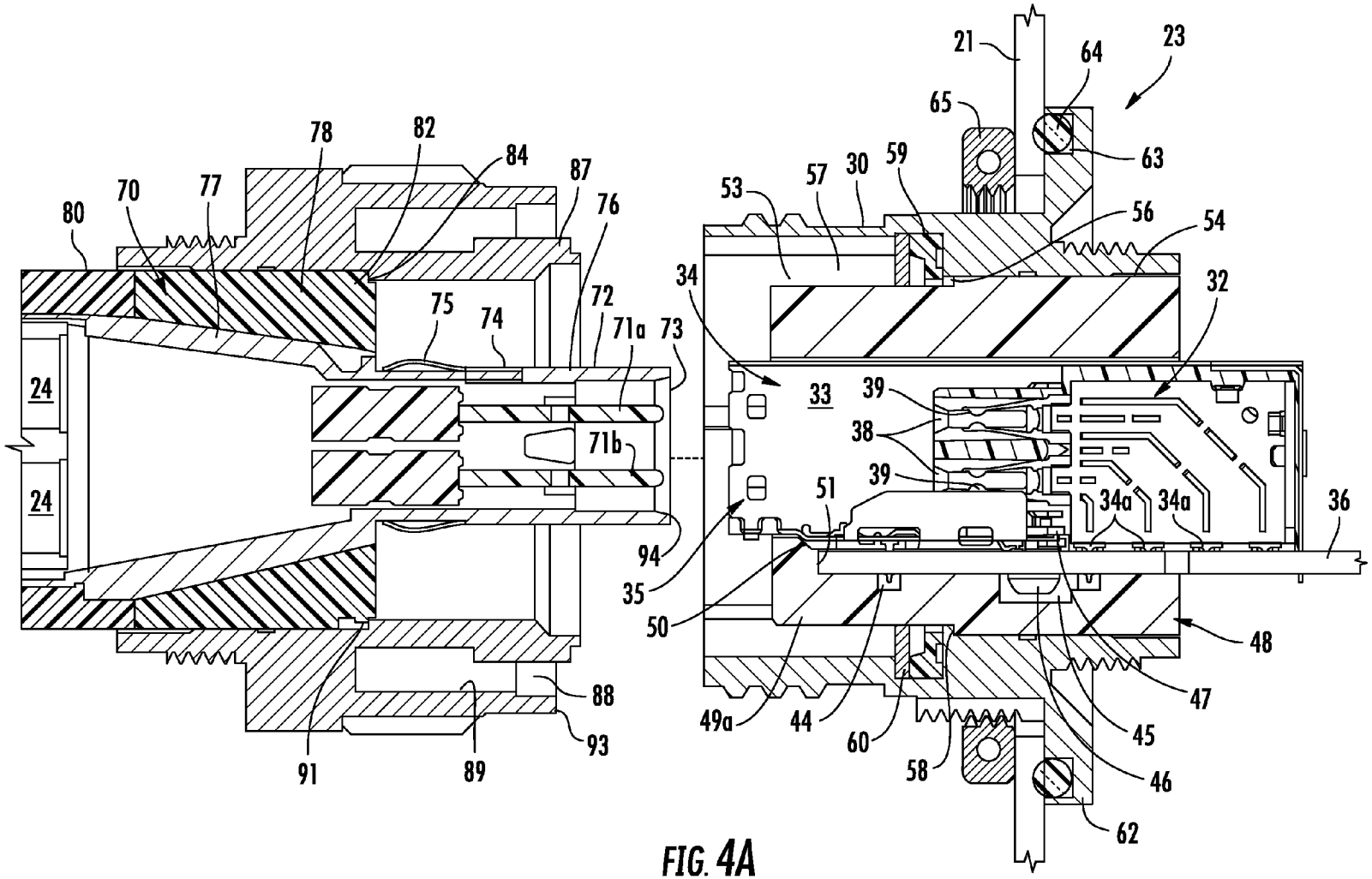
FIG. 4A is the same view as FIG. 4, but with the connector housings section for clarity to illustrate the contact arrangement of the connector assembly of FIG. 1.
Figure 5:
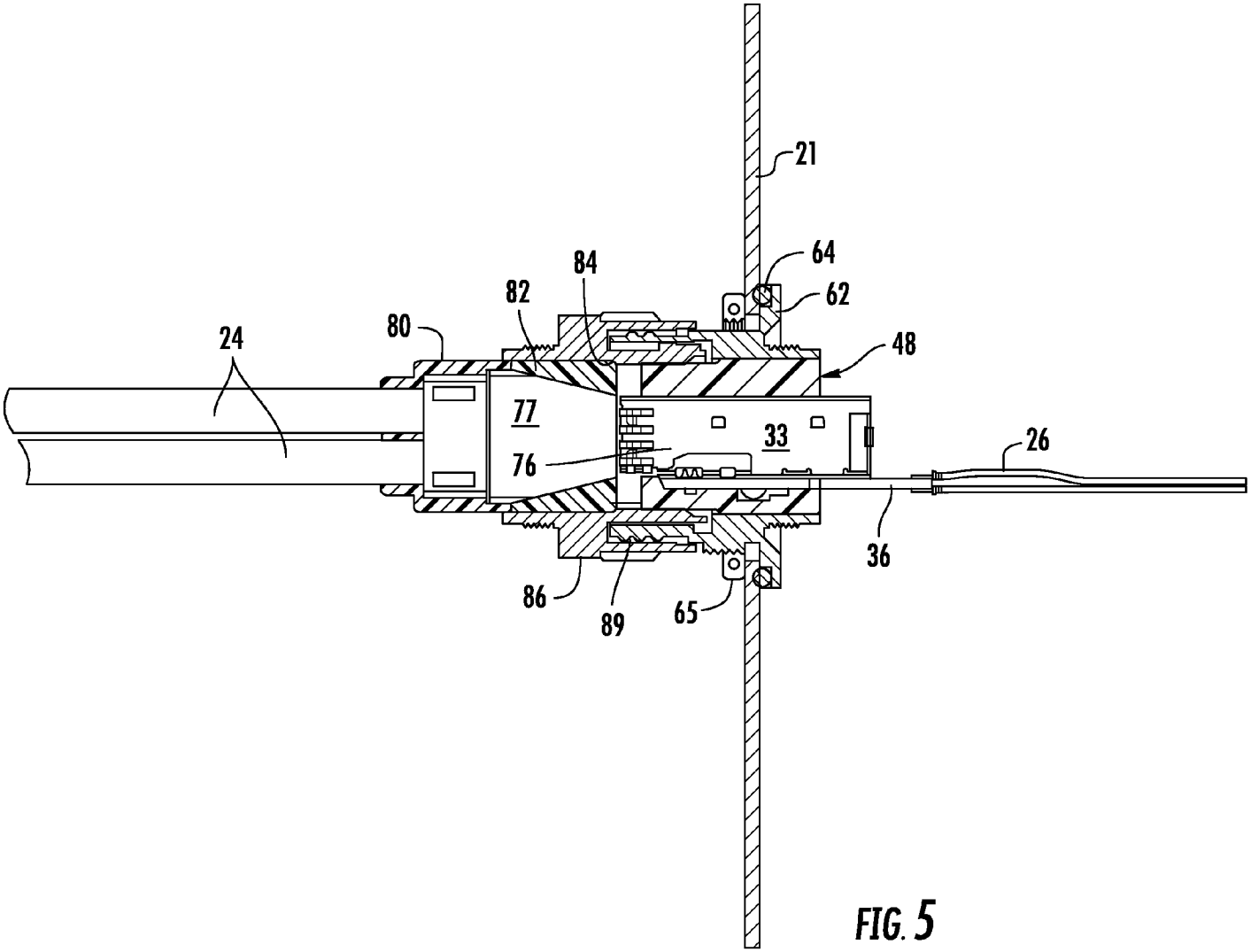
FIG. 5 is the same view as FIG. 4, but with the two connector components mated together.

As shown in FIGS. 3A and 4, an insulative, inner housing 78 is utilized to encompass the rear part 77 of the male connector half 70 up to the forward end of the boot portion 80. This inner housing 78 extends forwardly to just rear of the ends of the EMI gasket spring fingers 75. The forward part 82 of the inner housing 78 includes a circumferential channel, or rim 84, that engages an inner shoulder 91 of a first connector shell 86. Retaining rings (not shown) may be used to retain the inner housing 78 and male connector half 70 in place within the first connector shell 86 in a manner such that the inner housing 78 and connector half 70 rotate as a unit within the first connector shell 86. Conversely, this rotational mounting permits the first and second connector shells 86, 60 to be rotated upon their inner connector halves 32, 70. The first and second connector shells 86, 60 are advanced into mating engagement with each other by rotation of the first connector shell 86 upon the second connector shell 60. In this embodiment, the forward mating end 94 of the male connector half 70 projects partially past the front edge 93 of the first connector shell 86 to permit alignment and lead-in to the receptacle connector half 32. As shown in FIG. 5, the length of the mated shields 33, 72 of the two connector halves 32, 70 has a length that is greater than the length of either of the first and second connector shells 86, 60, and of the length of the first and second connector shells 86, 60, when mated together. By providing matable conductive housings or shields 33, 70 enclosed within the first and second connector shells 86, 60, the high data transmission speed of the SAS style connectors are achievable with minimal interfering crosstalk and noise.

Figure 6:
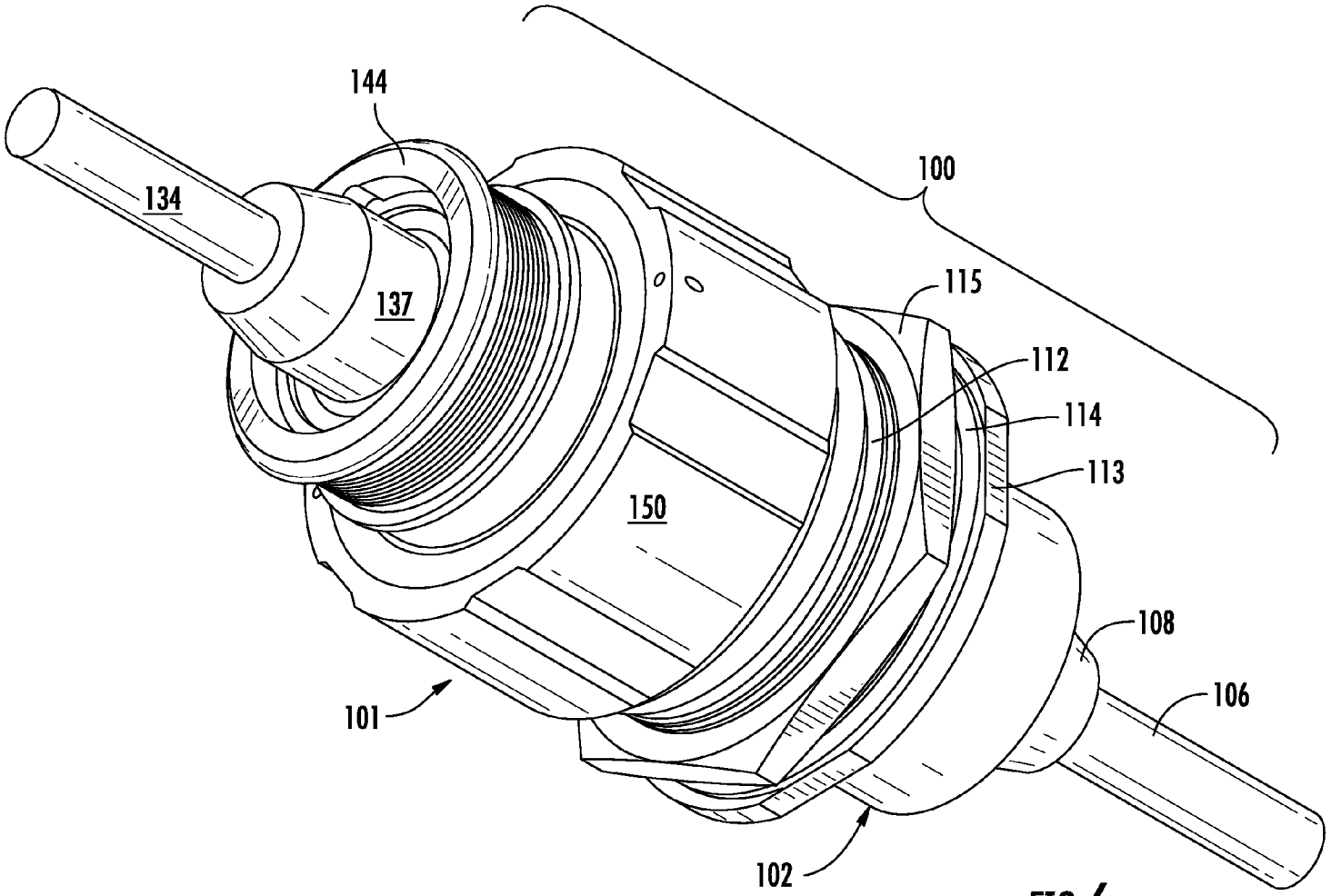
FIG. 6 is a perspective view of another embodiment of a connector assembly in accordance with the Present Disclosure that utilizes HDMI style connector halves.
Figure 6A:
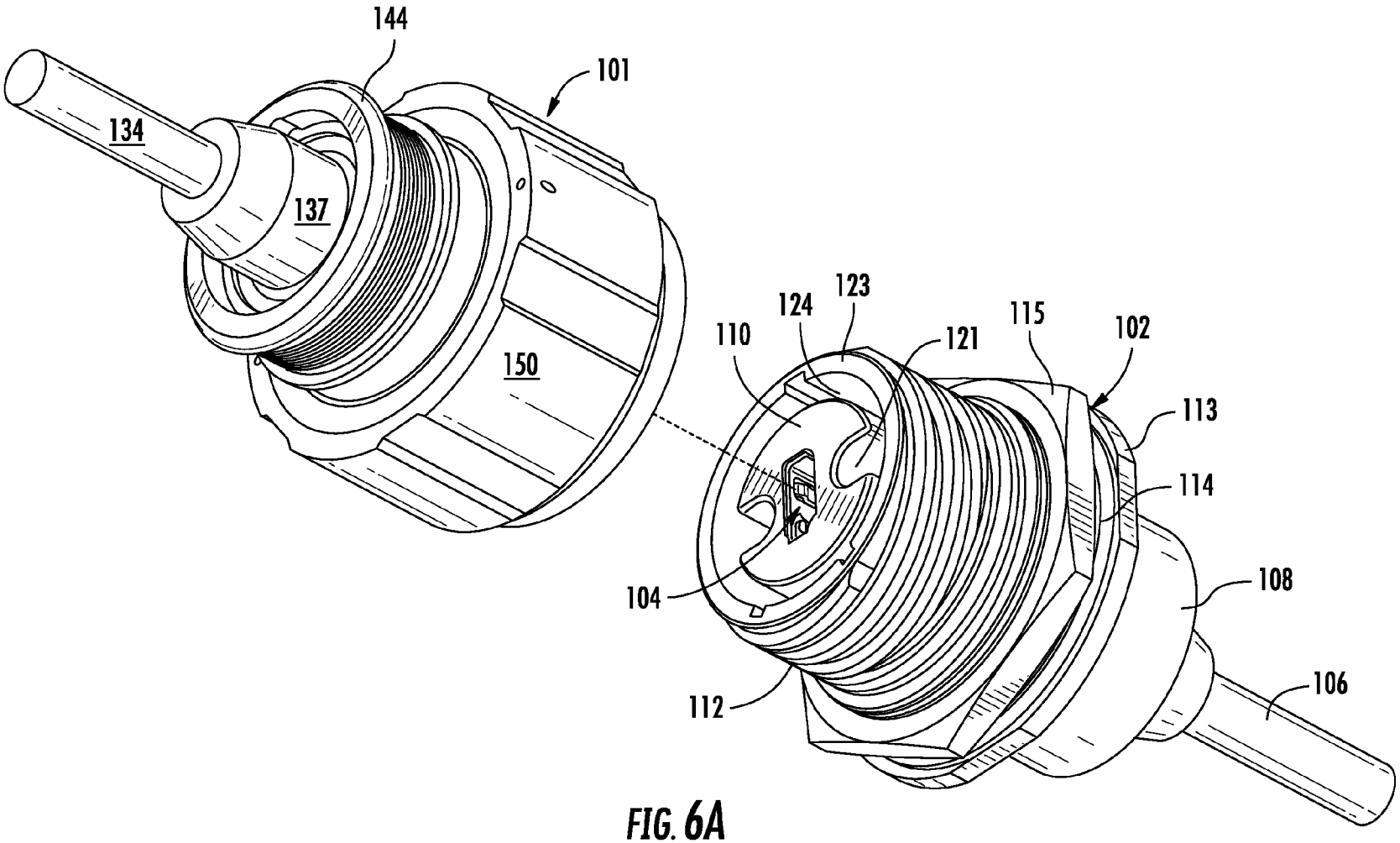
FIG. 6A is the same view as FIG. 6, but with the two connector components disengaged from each other.
Figure 7:
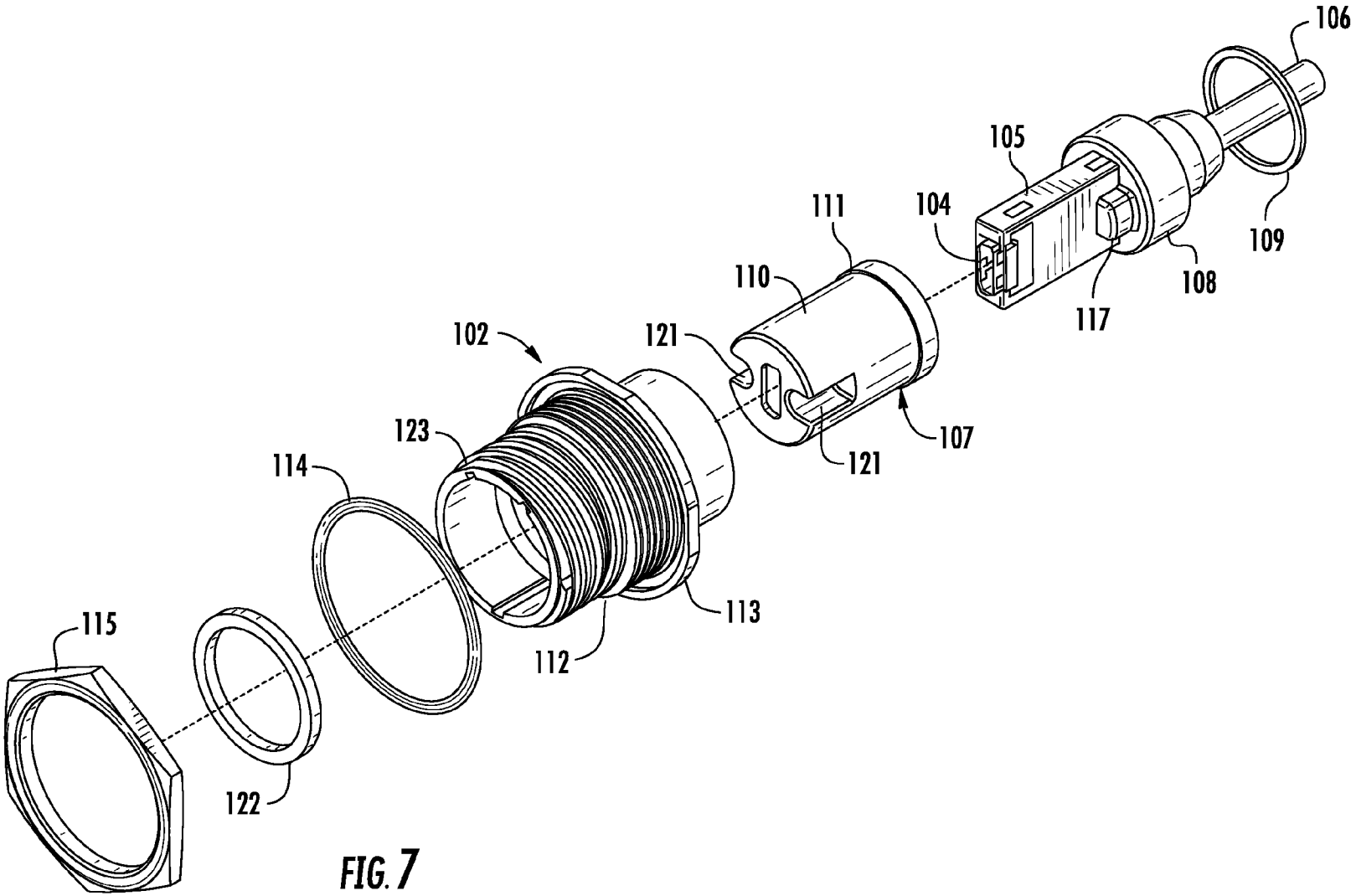
FIG. 7 is an exploded view of the male connector component of the connector assembly of FIG. 6.
Figure 7A:
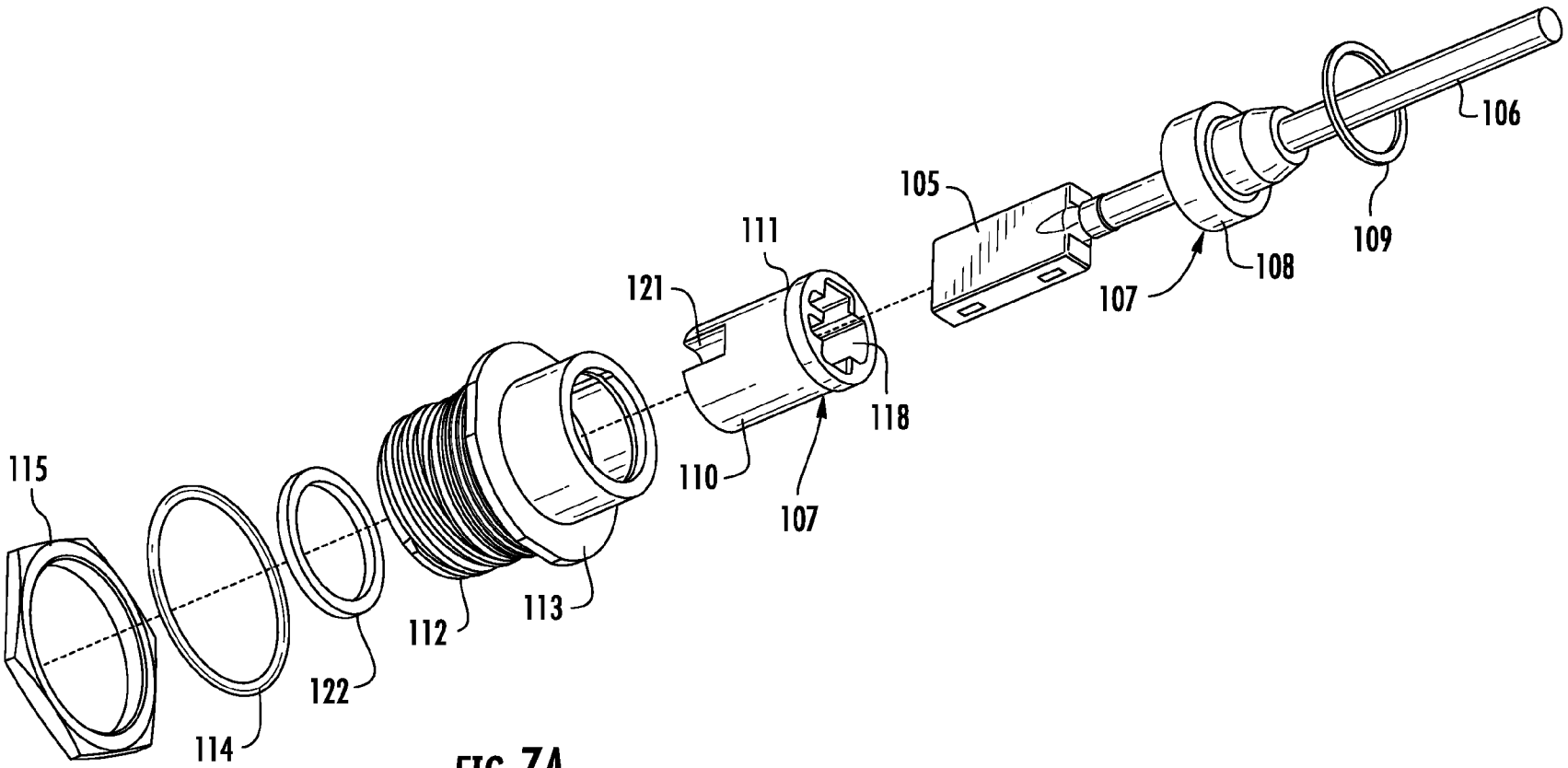
FIG. 7A is the same view as FIG. 7, but taken from the opposite end thereof.

FIGS. 6-11 illustrate another embodiment of a high speed connector assembly 100 in accordance with the principles of the Present Disclosure. This embodiment is particularly suitable for use with HDMI-style connector halves. As shown in FIG. 6, the connector assembly 100 includes first and second connector shells 144, 112 that have threaded bodies and internal bores, with the body and bore of one of the two connector shells 144 being larger than the other connector shell 112 so that the one connector shell 144 may telescopically engage the other connector shell 112. Both connector shells 144, 112 are threaded so that once the connector shells are aligned with each other, the second, outer connector shell 144 can be rotated upon the first, inner connector shell 112 so that the outer shell advances its inner components, namely the first (male) connector half 130, forwardly into mating engagement with the opposing second (female) connector half 104.

The second connector shell 112 houses a female, or receptacle, connector half 104. As shown in the exploded view of FIGS. 7-8, the receptacle connector half 104 includes a grounding shield 105 that substantially encloses the second connector half 104, and further includes an extension 105*a* configured to receive a like extension 133 of the first connector half 130. The grounding shield 105 is held within a rear boot portion 108 that covers the termination area of the cable wires and the receptacle connector contact tail portions. A cylindrical insulative inner housing 107, which includes the boot portion 108, encloses the balance of the receptacle connector half 104 and its grounding shield 105. Similar to the first embodiment, the inner housing 107 has a circumferential rim 111 that abuts an inner shoulder 120 disposed within the interior of the second connector shell 112. In the annular channel 124, disposed between the inner housing 107 and the second connector shell 112, sits a deformable ring 122 that provides a seal to the connector assembly 100 when the front edge 145 of the first connector shell 144 is brought into contact with it. A retaining ring 109 is provided to hold the inner housing front part 110 and boot portion 108 in place within the second connector shell 112, and is disposed along a rear face of the boot portion 108. This retention permits the inner housing 107, receptacle connector half 104 and grounding shield 105 to be rotated as a unit within the second connector shell 112, and further permits mating of the two connector shells 112, 144, in the manner described above.

Figure 8:
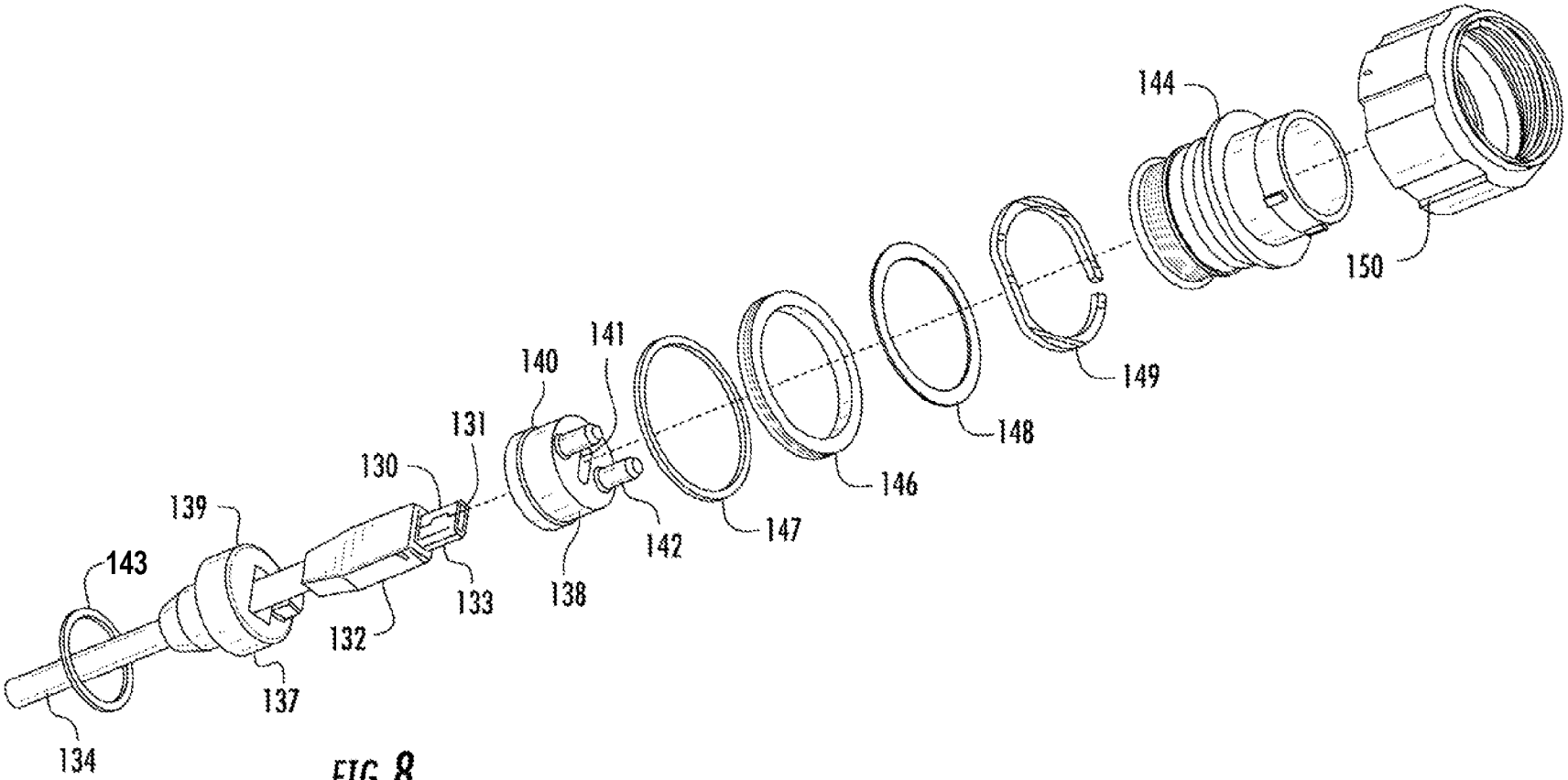
FIG. 8 is an exploded view of the female connector component of the connector assembly of FIG. 6.
Figure 9:
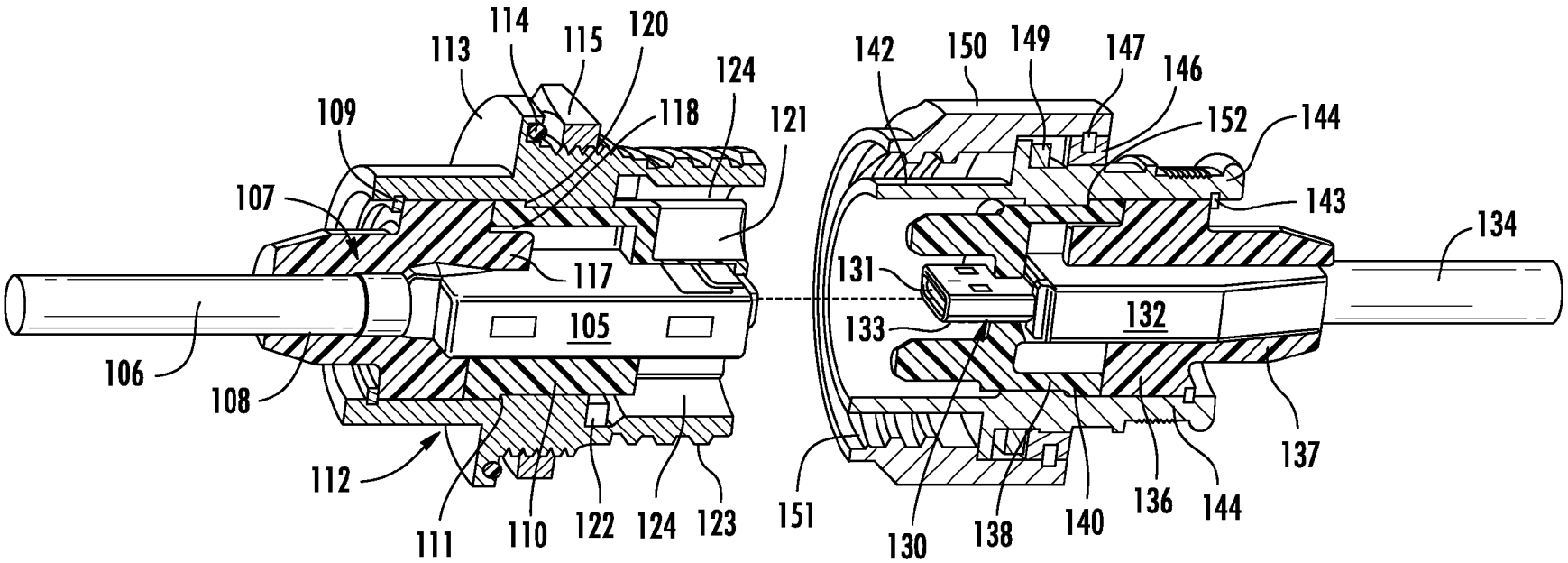
FIG. 9 is a sectional view of the two connector components of the connector assembly of FIG. 6 aligned together for subsequent mating.
Figure 9A:
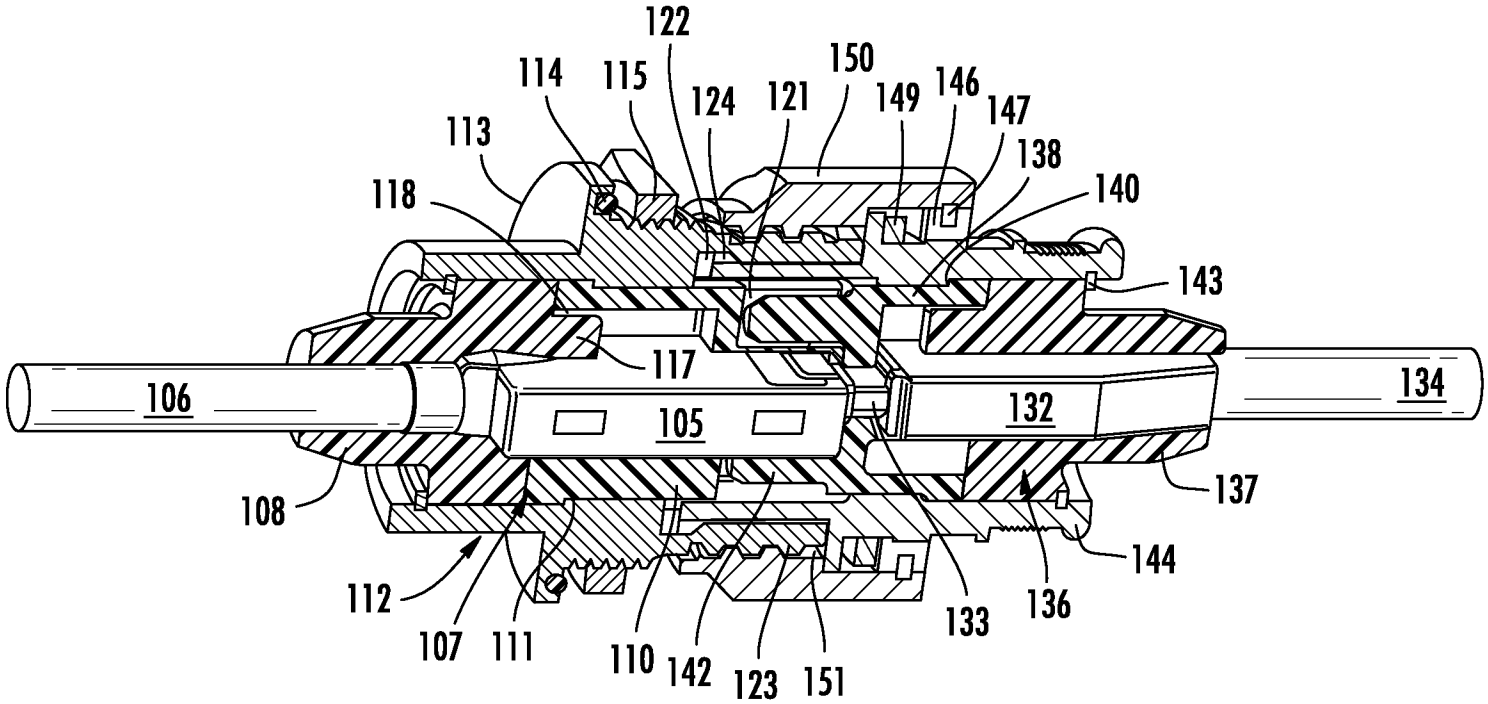
FIG. 9A is the same view as FIG. 9, but with the two connector components mated together.
Figure 10:
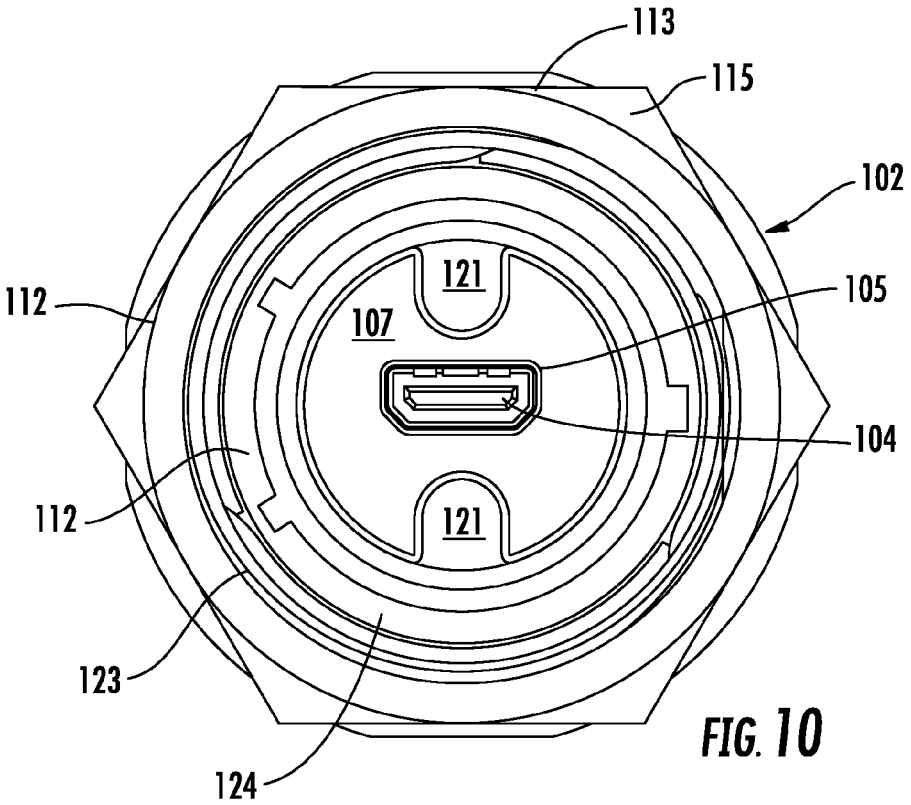
FIG. 10 is a front elevational view of the male connector component of the connector assembly of FIG. 6.
Figure 11:
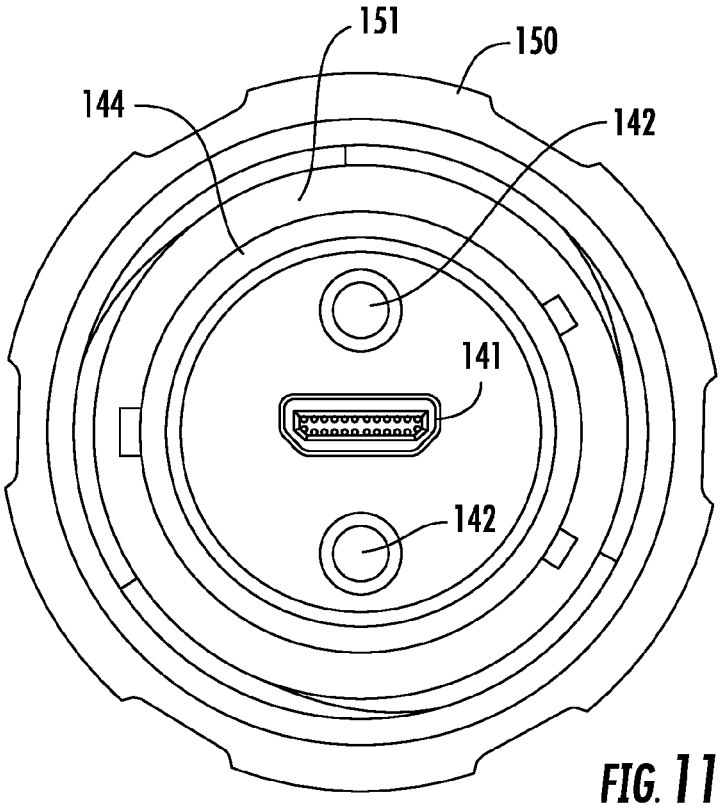
FIG. 11 is a front elevational view of the female connector component of the connector assembly of FIG. 6.

Turning now to FIGS. 8-9A, the first (male) connector half 130 is housed within its own associated grounding shield 132 and extension 133 and is terminated to wires of a cable 134. The first connector half 130 is also enclosed within a two-part inner housing 136 that comprises a rear boot portion 137 and a front portion 138, both of which are cylindrical in configuration. The front portion 138 includes a mating projection 142 that engages a mating notch 121 in the inner housing front part 110. The boot portion 137 has circumferential rim 134 upon which the rear end of the front portion 138 rests. A retaining ring 143 is provided that bears against the boot portion 137 to hold the inner housing 136 in place within the first connector shell 144 so that an inner housing rim 140 abuts against an inner shoulder 152 thereof. In the space between the first connector shell 144 and its outer threaded collar 150, there is a retention assembly that includes a spacer ring 146 and retainer 147 that holds the first connector shell 144 to the outer collar 150 so that the first connector shell 144 and its inner components can rotate relative to the outer collar 150. A wave spring 149 is further disposed in this space and the spring 149 urges the first connector shell 144 into contact with the flexible seal ring 122 of the second connector shell 112 to provide an environmental seal. The grounding shields 105, 107 of this embodiment each preferably have individual lengths that do not extend past the front edges of their respective connector shells, and when mated together, have a combined length longer than the length of any one of the two connector shells.

In this manner, high speed operation of these connectors may be achieved at minimal cost as only one ground is provided for each plurality of contacts for each respective male and female connector half, rather than providing individual grounds for each single contact as would be the case if conductive pins were used for the contacts. The connector inner housings are non-conductive and thus the connector shells may be either formed from or plated with a conductive material to provide the connector assemblies of the Present Disclosure with an outer, exterior ground that matches that of the cables to which it connects.

While a preferred embodiment of the Present Disclosure is shown and described, it is envisioned that those skilled in the art may devise various modifications without departing from the spirit and scope of the foregoing Description and the appended Claims.

What is claimed is:

1. A connector assembly comprising:

first and second interengaging connector shells;

first and second insulative connector housings respectively supported within the first and second connector shells;

first and second connector halves respectively supported by the first and second connector housings, each connector half including respective first and second pluralities of conductive contacts arranged within their respective connector housings in at least two spaced apart rows, each row extending transversely with respect to longitudinal axes of the first and second connector shells, the first connector half including a female receptacle portion and a first conductive grounding shield with a hollow interior that encloses the first contacts, the second connector half including a male mating portion and a second conductive grounding shield with a hollow interior that encloses the second contacts, the first and second contacts being disposed within their respective connector halves such that when the first and second connector housings are engaged together in an axial movement, the first and second contacts and the first and second grounding shields engage each other, the first and second grounding shields having a combined length when mated together, larger than at least a length of one of the first and second connector shells;

the first and second connector housings respectively including a complementary mating projection and mating notch that align the first and second connector halves together prior to and during mating, and the first and second connector housings being rotatably mounted in the first and second connector shells, whereby rotation of one of the first and second connector shells upon the other linearly advances the connector halves together, wherein a first and second inner housings include rim portion and the first and second connector shells include inner shoulder portions, the rim portions of the first and second inner housings abuttingly engaging the first and second inner shoulder portions; and retaining rings which engage the first and second connector shells rearwardly of the first and second inner housings and hold the first and second inner housings in place so as to permit rotational movement of the first and second inner housings and the first and second connector halves as units within the first and second connector shells.

2. The connector assembly of claim 1, wherein each of the first and second connector inner housing include first and second housing parts that attached to the connector halves from opposite ends thereof.

3. The connector assembly of claim 1, wherein one of the first and second grounding shields includes a multi-walled hollow enclosure that substantially encloses the connector half.

4. The connector assembly of claim 1, wherein the second grounding shields includes a conductive housing that supports two mating blades, spaced apart vertically, within the conductive housing.

5. The connector assembly of claim 1, wherein the first and second connector shells are conductive and provide an outer shield around the first and second inner housings and the first and second connector halves.

6. The connector assembly of claim 1, wherein each of the first and second grounding shields are recessed with the first and second connector shells.

7. The connector assembly of claim 1, wherein at least one of the second grounding shields has a length longer than the second connector shell such that a portion of it projects past a forward edge of the second connector shell.

8. The connector assembly of claim 1, wherein when the first and second connector halves are mated together, the first and second grounding shields extend axially through the connector assembly for a length larger than a length of any one of the first and second connector shells.

9. The connector assembly of claim 1, wherein the first and second inner housings include two parts, one of the two parts being a boot portion that encloses ends of cable wires and which further abuts a second of the inner housing two parts.

10. A connector assembly, the connector assembly comprising:

first and second interengaging connector shells;

first and second insulative connector housings respectively supported within the first and second connector shells; and first and second connector halves respectively supported by the first and second connector housings, each connector half including respective first and second pluralities of conductive contacts arranged within their respective connector housings in at least two spaced apart rows, each row extending transversely with respect to longitudinal axes of the first and second connector shells, the first connector half including a female receptacle portion and a first conductive grounding shield with a hollow interior that encloses the first contacts, the second connector half including a male mating portion and a second conductive grounding shield with a hollow interior that encloses the second contacts, the first and second contacts being disposed within their respective connector halves such that when the first and second connector housings are engaged together in an axial movement, the first and second contacts and the first and second grounding shields engage each other, the first and second grounding shields having a combined length when mated together, larger than at least a length of one of the first and second connector shells;

the first and second connector housings including a complementary mating projection and mating notch that align the first and second connector halves together prior to and during mating, and the first and second connector housings being rotatably mounted in the first and second connector shells, whereby rotation of one of the first and second connector shells upon the other linearly advances the connector halves together, wherein one of the first and second grounding shields includes a shielding cage mounted to a circuit board, the shielding cage having an opening disposed at a front end thereof and the connector half within the shielding cage and spaced rearwardly of the shielding cage front opening.

11. A connector assembly, the connector assembly comprising:

first and second interengaging connector shells;

first and second insulative connector housings respectively supported within the first and second connector shells; and first and second connector halves respectively supported by the first and second connector housings, each connector half including respective first and second pluralities of conductive contacts arranged within their respective connector housings in at least two spaced apart rows, each row extending transversely with respect to longitudinal axes of the first and second connector shells, the first connector half including a female receptacle portion and a first conductive grounding shield with a hollow interior that encloses the first contacts, the second connector half including a male mating portion and a second conductive grounding shield with a hollow interior that encloses the second contacts, the first and second contacts being disposed within their respective connector halves such that when the first and second connector housings are engaged together in an axial movement, the first and second contacts and the first and second grounding shields engage each other, the first and second grounding shields having a combined length when mated together, larger than at least a length of one of the first and second connector shells;

the first and second connector housings including a complementary mating projection and mating notch that align the first and second connector halves together prior to and during mating, and the first and second connector housings being rotatably mounted in the first and second connector shells, whereby rotation of one of the first and second connector shells upon the other linearly advances the connector halves together, wherein the second grounding shields includes a conductive housing that supports two mating blades, spaced apart vertically, within the conductive housing and wherein the conductive housing includes an EMI gasket supported thereon for contacting a shielding cage of an opposing connector.

12. A connector assembly, the connector assembly comprising:

first and second interengaging connector shells;

first and second insulative connector housings respectively supported within the first and second connector shells; and first and second connector halves respectively supported by the first and second connector housings, each connector half including respective first and second pluralities of conductive contacts arranged within their respective connector housings in at least two spaced apart rows, each row extending transversely with respect to longitudinal axes of the first and second connector shells, the first connector half including a female receptacle portion and a first conductive grounding shield with a hollow interior that encloses the first contacts, the second connector half including a male mating portion and a second conductive grounding shield with a hollow interior that encloses the second contacts, the first and second contacts being disposed within their respective connector halves such that when the first and second connector housings are engaged together in an axial movement, the first and second contacts and the first and second grounding shields engage each other, the first and second grounding shields having a combined length when mated together, larger than at least a length of one of the first and second connector shells;

the first and second connector housings including a complementary mating projection and mating notch that align the first and second connector halves together prior to and during mating, and the first and second connector housings being rotatably mounted in the first and second connector shells, whereby rotation of one of the first and second connector shells upon the other linearly advances the connector halves together, wherein the second grounding shields includes a conductive housing that supports two mating blades, spaced apart vertically, within the conductive housing and wherein the conductive housing has a small front portion relative to a large rear portion.

* * * * *